US005259289A

United States Patent [19]

Peries et al.

[11] Patent Number: 5,259,289

[45] Date of Patent: Nov. 9, 1993

[54] MUNITIONS LAUNCHER

[75] Inventors: Francis Peries, Fronton; Hervé Tustes, Frouzins, both of France

[73] Assignee: Etienne Lacroix Tous Artifices S.A., Muret, France

[21] Appl. No.: 836,584

[22] Filed: Feb. 18, 1992

[30] Foreign Application Priority Data

Feb. 18, 1991 [FR] France ..... 91 01887

[51] Int. Cl.[5] ..... F41F 1/08; F42B 4/26; F42B 12/70

[52] U.S. Cl. ..... 89/1.41; 102/335; 102/505

[58] Field of Search ..... 89/1.41, 1.3, 1.35, 89/1.816, 1.8; 102/334, 342, 505

[56] References Cited

U.S. PATENT DOCUMENTS

| | | | |
|---|---|---|---|
| 3,501,997 | 3/1970 | Winsen et al. | 89/1.3 |
| 3,712,224 | 1/1973 | Hanzel | 102/342 |
| 3,841,197 | 10/1974 | Morrisey | 89/1.816 |
| 3,855,899 | 12/1974 | Billottet et al. | 89/1.41 |
| 3,964,393 | 6/1976 | Foote et al. | 102/342 |
| 4,012,985 | 3/1977 | Magnusson | 89/1.3 |
| 4,063,485 | 12/1977 | Carter | 89/1.816 |
| 4,222,306 | 9/1980 | Maury | 89/1.41 |
| 4,454,816 | 6/1984 | Billard et al. | 102/505 |
| 4,458,597 | 7/1984 | Reynes | 102/505 |
| 4,726,295 | 2/1988 | Embry et al. | 102/505 |
| 5,058,481 | 10/1991 | Drummond et al. | 89/1.816 |

FOREIGN PATENT DOCUMENTS

| | | |
|---|---|---|
| 3801564 | 8/1989 | Fed. Rep. of Germany . |
| 3904293 | 8/1990 | Fed. Rep. of Germany . |

*Primary Examiner*—David H. Brown
*Attorney, Agent, or Firm*—Cushman, Darby & Cushman

[57] ABSTRACT

A munitions launcher comprising a plurality of ejector assemblies each suitable for receiving a munition, and a base made of thermoplastic material molded over a portion of the periphery of the various ejector assemblies and over the rear thereof.

26 Claims, 6 Drawing Sheets

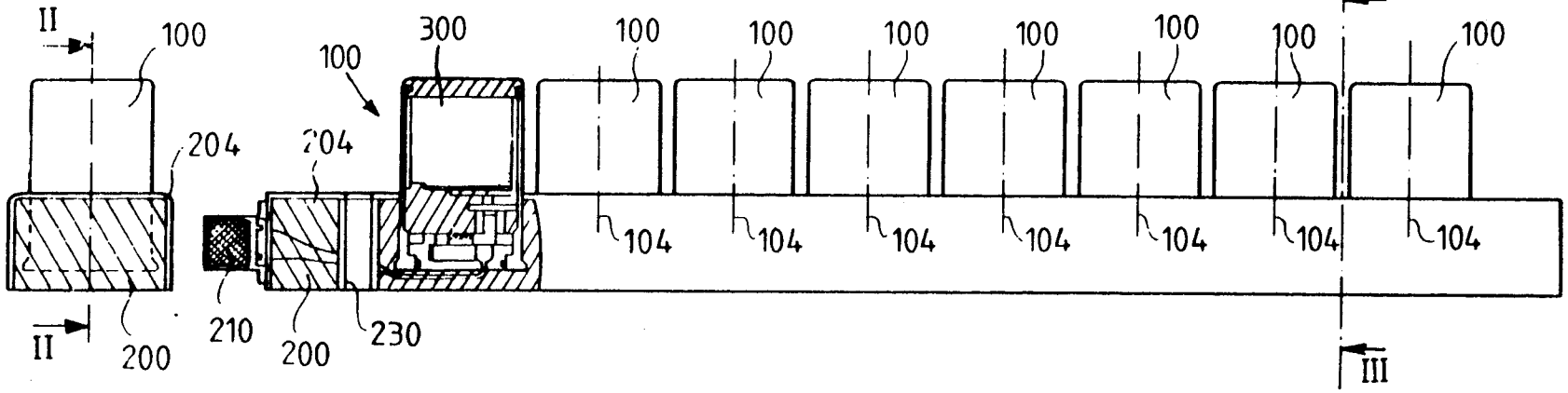
FIG. 2.
FIG. 3.
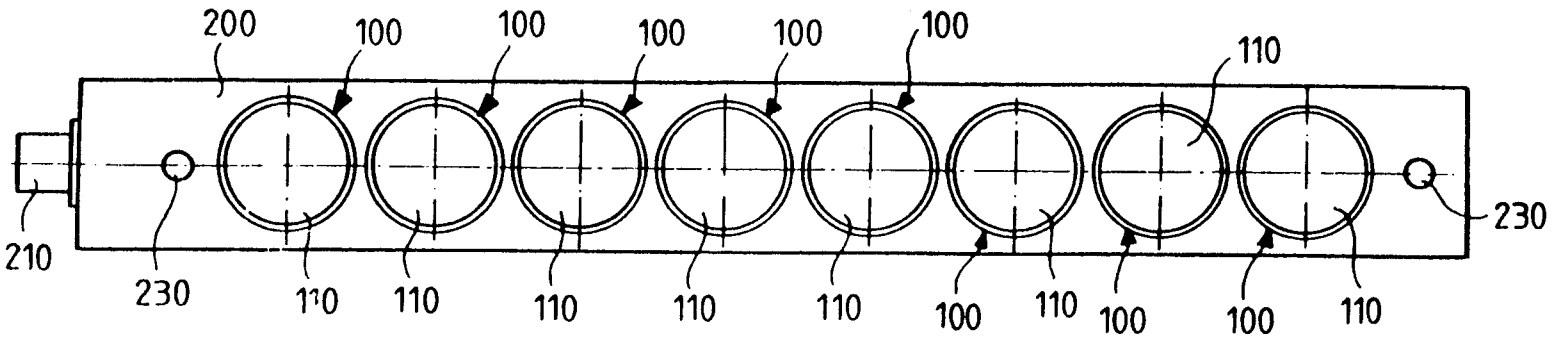
FIG. 1.

MUNITIONS LAUNCHER

The present invention relates to munitions launchers.

BACKGROUND OF THE INVENTION

An object of the present invention is to provide a novel munitions launcher designed to limit the forces that are applied to the launcher support.

The present invention is particularly, but not exclusively, applicable to munitions launchers, e.g. launchers of infrared or electromagnetic decoys and designed to be mounted on aircraft. Although this application is not limiting, the present invention is particularly suitable for launchers of infrared or electromagnetic decoys for the purpose of protecting lightweight helicopters against missiles fitted with their own target-seeking systems or against fire control weapons systems.

SUMMARY OF THE INVENTION

According to the present invention, this object is achieved by a launcher comprising a plurality of ejector assemblies each suitable for receiving a munition, and a base made of thermoplastic material molded over a portion of the periphery of the various ejector assemblies and over the rear thereof.

BRIEF DESCRIPTION OF THE DRAWINGS

An embodiment of the invention is described by way of example with reference to the accompanying drawings, in which:

FIG. 1 is a plan view of a munitions launcher in accordance with the present invention;

FIG. 2 is an elevation view of the same launcher shown partially in section on a plane reference II—II in FIG. 3;

FIG. 3 is a diagrammatic cross-section through the same launcher on a plane referenced III—III in FIG. 2;

DETAILED DESCRIPTION

The munitions launcher of the present invention shown in the accompanying figures comprises a plurality of ejector assemblies 100 each suitable for receiving a munition 300, and a base 200 made of thermoplastic material molded over a portion of the periphery of each of the various ejector assemblies 100.

The description begins with the ejector assemblies 100 as shown in the accompanying figures.

Figure 4:
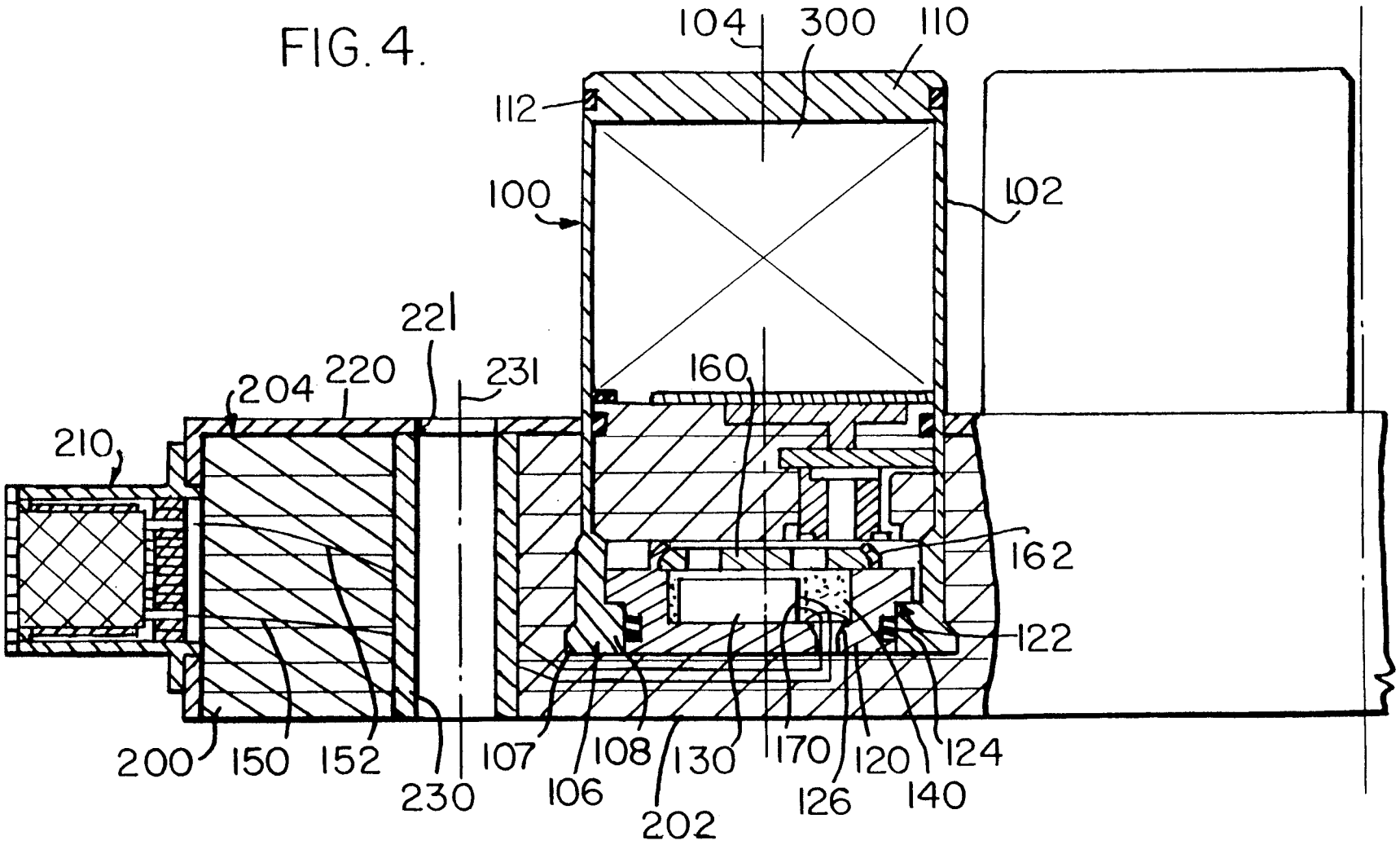
FIG. 4 is a fragmentary section view similar to FIG. 2 and on a larger scale.

As can be seen in particular in FIG. 4, each ejector assembly 100 comprises a socket 102 which acts as a launch tube. The sockets 102 are preferably made of light alloy. Each socket 102 is centered on an axis 104. The various axes 104 of the sockets 102 are preferably parallel to one another.

It may be observed that the socket 102 has a stepped base 106. More precisely, each socket 102 has both an outside annular rib 107 and an inside annular rib 108 in its base 106.

At its leading end, each socket 102 is closed by ejectable cover 110 provided with a sealing O-ring 112 received in an annular groove. The ring 112 provides sealing between the cover 110 and the socket 102.

At its rear end, the socket 102 is provided with a socket plug 120. The socket plug 120 is advantageously made of light alloy. Its outside periphery 122 is likewise stepped such that the socket plug 120 pressed against the above-mentioned annular rib 108. A sealing O-ring 124 is preferably engaged in a groove formed in the outside peripheral surface of the socket plug 120 to provide sealing between the plug and the associated socket 102.

Each socket plug 120 supports a firing igniter 130. It is preferably in the form of an electrical igniter.

The igniters 130 communicate with propellant changes 140 likewise supported by the socket plugs 120. The igniters 130 are powered via pairs of connection wires 150 and 152. To simplify the illustration, only one pair of wires 150 and 152 is shown in the figures. However, a pair of feed wires 150 and 152 is provided for each igniter 130, and thus for each socket 102 in the launcher.

The feed wires 150 and 152 run from a connector 210 carried by the base 200. The wires then run through the base 200 and terminate at the igniters 130. More precisely, the feed wires 150 and 152 pass through the associated socket plug 120 via a feed through 126 before terminating at the igniter 130.

As shown in FIG. 4, each socket plug 120 preferably supports a steel grid 160 in front of the igniters 130 and the propellent charges 140. An aluminum mat 170 is preferably interposed between the steel grid 160 and the propellant charge 140. The steel grid 160 and the aluminum mat 170 may be held against the socket plug 120 by crimping at 162.

As mentioned above, the base 200 comprises a body of thermoplastic material molded over a portion of the periphery of the ejector assemblies 100 and over the rear ends thereof.

The base 200 may be made of any suitable conventional material. Nevertheless, it is preferably made of polyurethane.

In the preferred embodiment shown in the accompanying drawings, the base 200 is molded over the rear half of the periphery of each socket 102 and over the rear thereof, i.e. over the rear ends of the socket plugs 120. The base 200 thus forms a sheet 202 where it underlies the socket plugs 120.

According to a preferred characteristic of the present invention, the thickness of this sheet 202 lies in the range 5 mm to 15 mm, and preferably in the range 8 mm to 9 mm.

Said thickness of the sheet 202 is measured in the direction of the axis 104.

The remainder of the base 200 which is in the form of a single overmolded part is preferably delimited by a generally rectangular envelope. As shown in FIG. 4, in particular, the base 200 is preferably covered on its side faces parallel to the axes 104 and on its front face 204, i.e. its face facing in the munition ejection direction, with a metal fairing 220. To secure the launcher on an appropriate support, e.g., a light helicopter, the base 200 is preferably provided with various spacers 230. The spacers 230 may be formed by cylindrical tubes, for example. The axes 231 of the spacers are parallel to the axes 104 of the sockets 102. The spacers 230 are naturally in alignment with openings 221 through the fairing. The base 200 is molded over the spacers 230. The spacers 230 enable the launcher to be fixed on any suitable support merely by means of bolts.

Figure 7:
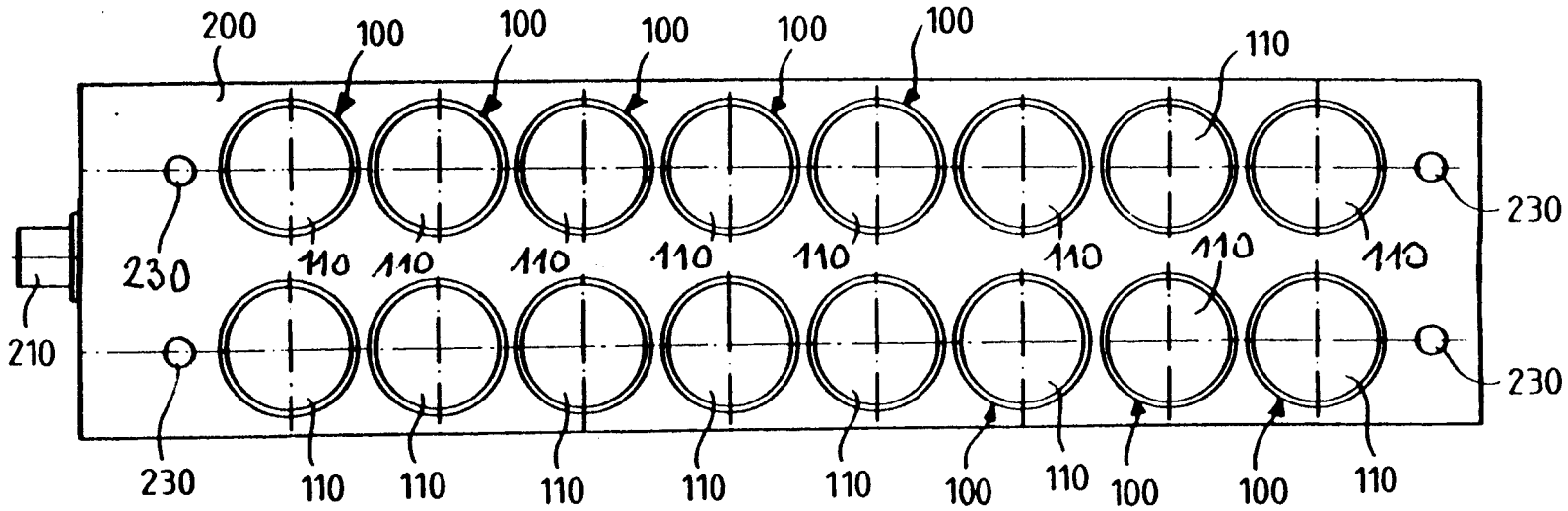
FIG. 7 is a plan view of a munitions launcher in accordance with another embodiment of the present invention.

The disposition of the ejector assemblies 100 on the base may vary in numerous ways. In FIGS. 2 and 3, a disposition is shown comprising a single roll of eight ejector assemblies any way. For example, the disposition may comprise N rows of M columns of ejector assemblies 100, or any other appropriate variant disposition. An example of such a disposition is shown in FIG. 7, which illustrates a munitions launcher comprising two rows, each having eight columns of ejector assemblies 100.

As mentioned above, a particular application of the present invention lies in launching munitions containing infrared or electromagnetic decoys. However such a disposition is not limiting in any way. The present invention can be used to launch any type of munition. That is why the munition constituting an infrared decoy and shown in the accompanying drawings is not described in greater detail below.

In essence, a launcher in accordance with the present invention operates as follows.

Each cartridge 300 contained in an ejector assembly 100 is fired via the connector 210. More precisely, an electrical igniter 130 is fired by applying an appropriate electrical current to the terminals of the connector 210 that are connected to the associated feed wires 150 and 152. Ignition of the electrical igniter 130 initiates the propellant charge 140. The thrust produced by the combustion gases generated in this way after the aluminum mat 170 has ruptured enables the ejected cartridge 300 to leave the socket 102 by uncrimping the socket where it holds the cover 110. Simultaneously, during propulsion, the combustion gases may light pyrotechnical means such as delay fuses included in the cartridge 300.

Figure 5:
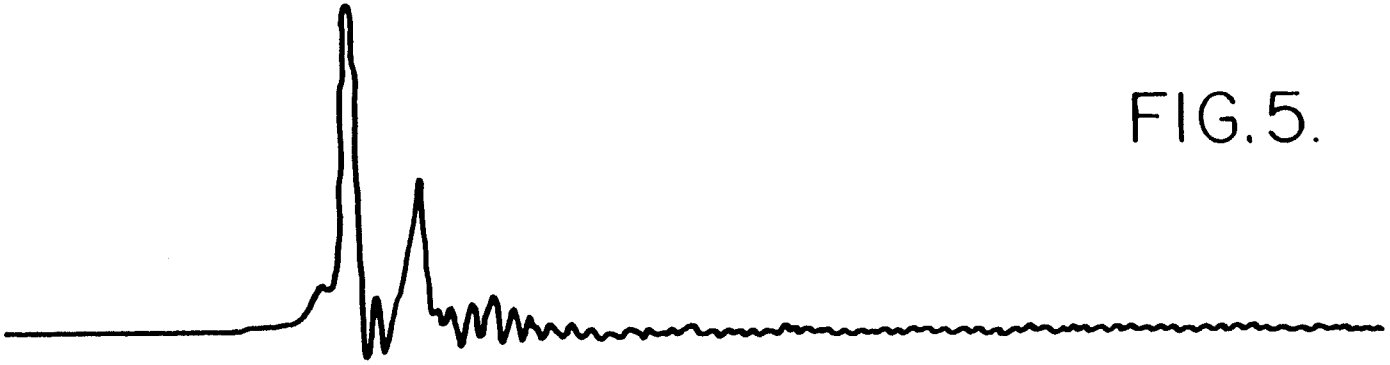
FIG. 5 is a graph showing the force applied to the support of a prior art ejector assembly while it is ejecting a munition.

Accompanying FIG. 5 shows the force applied to a support plate while launching a cartridge 300 by means of a launcher 100 without any base 200 having a sheet 202 molded over the rear of the launcher 100.

Figure 6:
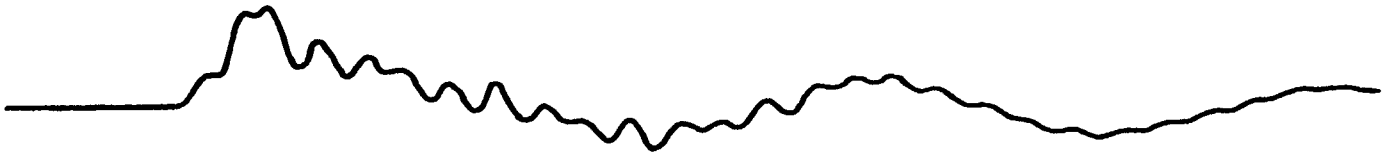
FIG. 6 shows the force applied to the support of a launcher in accordance with the present invention while it is ejecting an identical munition.

FIG. 6 shows the force applied to a support plate while launching the same cartridge from a launcher in accordance with the present invention.

The peak force measured during cartridge launching using a conventional launcher as shown in FIG. 5 was 252 daN. In contrast, the peak force shown in FIG. 6 measured while launching the same cartridge from a launcher in accordance with the present invention was only 75 daN. It will consequently be observed that a very considerable amount of shock absorption is obtained by having the sheet 202 which is integrally molded with the base 200 overlying the rear ends of the socket plugs 120.

In conclusion, it may be said that the base 200 performs two functions; firstly the base 200 mechanically interconnects the various ejector assemblies 100 accurately, and secondly the base 200 provides shock absorbing.

Naturally, the present invention is not limited to the particular embodiment described above but extends to any variant coming within the spirit of the invention.

Figure 8:
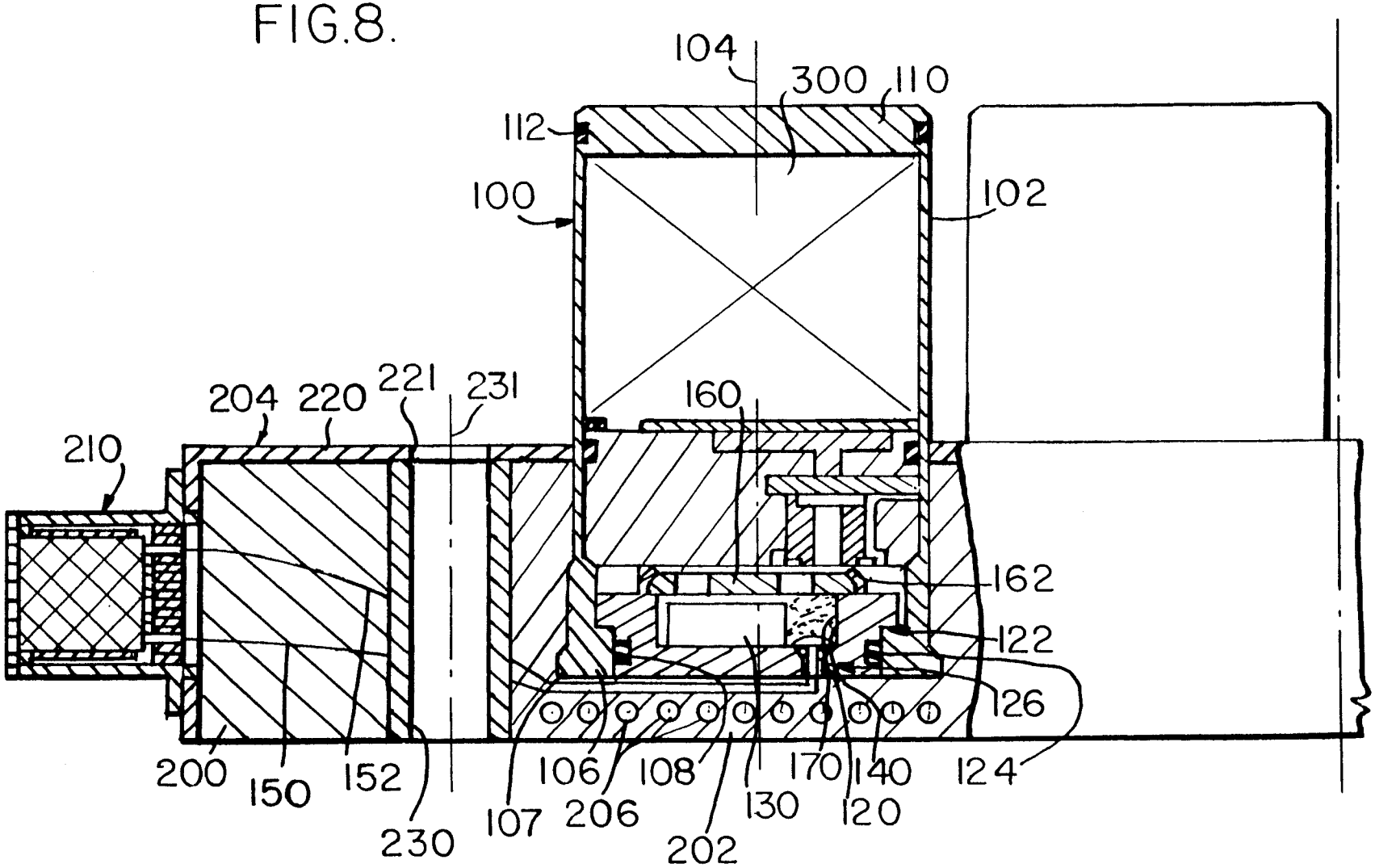
FIGS. 8 and 9 are fragmentary sectional views similar to FIG. 4 of two other embodiments of the present invention.

Thus, for example, as illustrated in FIG. 8, to improve the shock absorbing effect, openings 206 may be formed in the sheet 202 molded over the rear of each socket plug 120.

Figure 9:
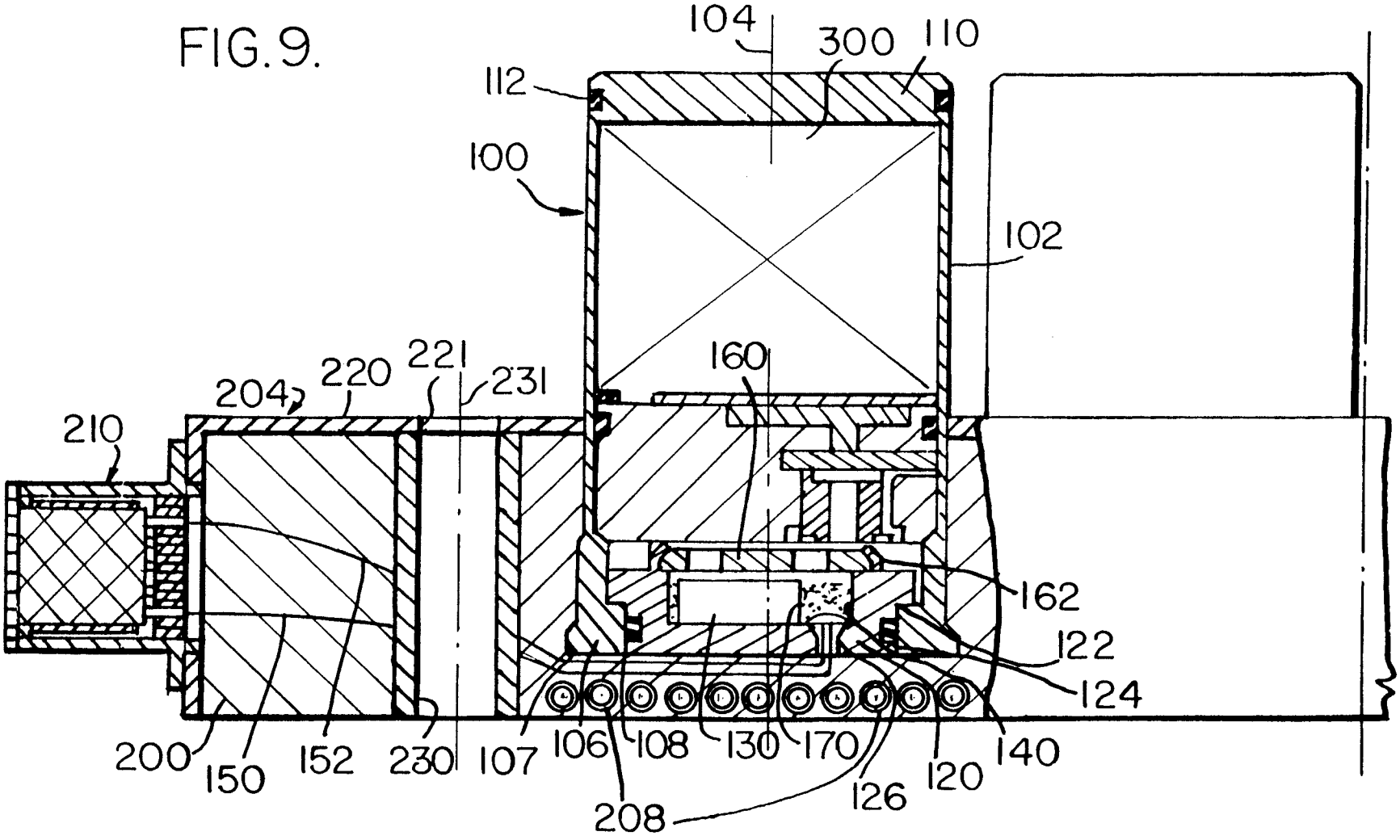

It is also possible to improve the shock absorbing effect by incorporating hollow balls 208 in the sheet 202 molded over the rear of each socket plug 120 as shown in FIG. 9.

Each of the balls advantageously includes at least one rigid skin.

The balls are preferably hollow balls made of metal or of plastic. Where appropriate, the balls may be in the form of a central core made of compressible material such as polystyrene, and surrounded by a rigid outer skin.

The balls may be using any conventional technique known to the person skilled in the art.

For example, the balls may be made by depositing a coating of porous nickel or of some other equivalent material on cores that are soluble in a solvent, then soaking the cores coated in this way in the solvent until the cores have dissolved away, as described, for example, in Document FR-A-2 585 373. Where appropriate, the soluble core may be eliminated by forming a hole through the coating as taught in Documents FR-A-1 311 777 and U.S. Pat. No. 4,464,231.

Naturally, the thickness of the rigid skin or coating on the balls, and the diameter of the balls may be varied in numerous different ways depending on the desired stiffness.

We claim:

1. A munitions launcher comprising;

a plurality of ejector assemblies each suitable for receiving a munition, each ejector assembly comprising a socket for receiving said munition and acting as a launch tube, a socket plug, an igniter and a propellent charge, wherein said socket is provided with an outside annular rib at its rear end, and a base made of thermoplastic material molded over a portion of the periphery of the various ejector assemblies so as to cover said outside annular rib, and over the rear thereof wherein said base interconnects the plurality of ejector assemblies and provides shock absorption, limiting the recoil peak force when launching said munition from an ejector assembly.

2. A launcher according to claim 1, wherein the base is made of polyurethane.

3. A launcher according to claim 1, wherein the base is covered by a metal fairing.

4. A launcher according to claim 1, wherein the base forms a sheet behind each ejector assembly, with the thickness of the sheet lying in the range 5 mm to 15 mm.

5. A launcher according to claim 1, wherein the base forms a sheet behind each ejector assembly, with the thickness of the sheet lying in the range 8 mm to 9 mm.

6. A launcher according to claim 1, wherein each igniter is an electrically-ignited igniter.

7. A launcher according to claim 1, wherein the base carries a connector for powering the igniters.

8. A launcher according to claim 1, wherein the base is provided with a plurality of spacers suitable for receiving fixing bolts for the launcher.

9. A launcher according to claim 1, wherein the ejector assemblies are disposed in a row.

10. A launcher according to claim 1, wherein the ejector assemblies are disposed in N rows of M columns.

11. A launcher according to claim 1, wherein openings are present in the base behind the ejector assemblies.

12. A launcher according to claim 1, wherein hollow balls are present in the base behind the ejector assemblies.

13. A munitions launcher comprising:

a plurality of ejector assemblies each suitable for receiving a munition, each of said ejector assemblies including a socket covered by an ejectable cover and a socket plug supporting an igniter and a propellant charge; and a base made of thermoplastic material molded over a portion of the periphery of the various ejector assemblies and over the rear thereof, wherein said cover is for covering said munition, and said base is for lessening shock on said launcher caused by firing said munition.

14. A launcher according to claim 13, wherein said socket is provided with an outside annular rib at its rear end, and said base is molded over said outside annular rib.

15. A launcher according to claim 13, wherein said base is made of polyurethane.

16. A launcher according to claim 13, wherein said base is covered by a metal fairing.

17. A launcher according to claim 13, wherein said base forms a sheet behind each ejector assembly, with the thickness of the sheet lying in the range of 5 mm to 15 mm.

18. A launcher according to claim 13, wherein said base forms a sheet behind each ejector assembly, with the thickness of the sheet lying in the range of 8 mm to 9 mm.

19. A launcher according to claim 13, wherein each igniter is an electrically-ignited igniter.

20. A launcher according to claim 13, wherein the base carries a connector for powering the igniters.

21. A launcher according to claim 13, wherein said base is provided with a plurality of spacers suitable for receiving fixing bolts for the launcher.

22. A launcher according to claim 13, wherein the ejector assemblies are disposed in a row.

23. A launcher according to claim 13, wherein the ejector assemblies are disposed in N rows, each having M columns.

24. A launcher according to claim 13, wherein openings are present in the base behind the ejector assemblies.

25. A launcher according to claim 13, wherein hollow balls are present in the base behind the ejector assemblies.

26. A munition launcher comprising:

a plurality of ejector assemblies each suitable for receiving a munition, each ejector assembly comprising a socket for receiving said munition and acting as a launch tube, a socket plug, an electrically ignited igniter, and a propellent charge, wherein said socket is provided with an outside annular rib at a rear end thereof;

a base made of polyurethane molded over a periphery of the various ejector assemblies so as to cover said outside annular rib, and over the rear thereof, so as to form a sheet behind each ejector assembly with a thickness lying in the range of from 8 mm to 9 mm;

a connector provided on the base for powering the igniters; and a metal fairing covering said base.

* * * * *